US005190490A

United States Patent [19]

Wachtel

[11] Patent Number: 5,190,490

[45] Date of Patent: Mar. 2, 1993

[54] ADJUSTABLE PIPE WAND FOR BUBBLES

[76] Inventor: Jack S. Wachtel, 1640 Lands End Rd., Pt. Manalapan, Fla. 33462

[21] Appl. No.: 822,177

[22] Filed: Jan. 16, 1992

[51] Int. Cl.[5] ..... A63H 33/28

[52] U.S. Cl. ..... 446/15; 446/16; 446/18

[58] Field of Search ..... 446/15, 16, 17, 18, 446/19, 20, 21

[56] References Cited

U.S. PATENT DOCUMENTS

| | | | |
|---|---|---|---|
| 2,118,748 | 5/1938 | Warham | 446/14 |
| 3,123,936 | 3/1964 | Feltman | 446/15 |
| 3,323,250 | 6/1967 | Gibbons | 446/15 |
| 3,443,337 | 5/1969 | Ehrlich | 446/19 |
| 3,745,693 | 7/1973 | LaFata et al. | 446/15 |
| 3,769,833 | 11/1973 | Ordway et al. | 446/15 X |
| 3,848,355 | 11/1974 | Weight | 446/17 |
| 4,867,724 | 9/1989 | Sheng | 446/15 X |
| 4,923,426 | 5/1990 | Klundt | 446/15 X |

*Primary Examiner*—Robert A. Hafer
*Assistant Examiner*—Sam Rimell
*Attorney, Agent, or Firm*—Malin, Haley, DiMaggio & Crosby

[57] ABSTRACT

The instant invention discloses a bubble pipe with the functionality of a bubble wand. The bubble pipe employs two tubes, one slidably insertable into the second, extending the distance of a bubble formation end away from the operator. Each tube includes a plurality of orifices placed therethrough for adjusting the velocity and volume of air used in formation of a bubble.

10 Claims, 1 Drawing Sheet

ADJUSTABLE PIPE WAND FOR BUBBLES

FIELD OF INVENTION

This invention relates generally to the field of novelty bubble production and, in particular, to an adjustable blow pipe for creating bubbles from an aqueous solution.

BACKGROUND OF THE INVENTION

Bubble formation continues to fascinate those who witness its creation. The scientist considers the bubble a spherical film of liquid inflated with air or other gas and may look at improving the bubble by use of a unique surfactant. Alternatively, the child considers the bubble nothing short of fascinating entertainment despite the lesson in surface tension displayed. For children the formation of the bubble takes on a special meaning. Those witnessing a child's attempt to make a bubble have undoubtedly witnessed the self-satisfaction a child finds upon accomplishing the feat.

Typically, three distinct constituents are required in the formation of a bubble: the aqueous solution, the gas medium for the interior of the bubble, and the apparatus for holding the solution in a manner that allows the combination to form a bubble. A detailed explanation of various types of solutions for making bubbles is exhaustively described in U.S. Pat. No. 4,246,717 issued to instant inventor Wachtel on Jan. 27, 1981. The gas medium is air as expelled by a child, the apparatus for holding the solution is the remaining subject of this invention.

A conventional apparatus for holding aqueous solutions is known as a "wand." The wand consists of a handle with a means for holding an aqueous solution at one end. The means for holding the solution typically consists of an opening with multiple ridges to which an aqueous solution may bridge. The ridges maintain the aqueous solution in a fixed position forming a thin film across the opening. To operate the device a child moves the wand quickly in hopes of sufficient air to fill the middle of the film and force the aqueous solution free of the ridge and into a bubble.

The problem with the wand is that children usually cannot move the wand fast enough and the solution simply falls off onto whatever is in its path. Another problem is that once a child learns that the formation of a bubble is best performed by air directed through the wand opening, the wand will continually be brought in close proximity to the child's mouth. This close proximity may result in the solution to drip onto the child's clothing or into the child's mouth. Further, if the child does not present a sufficient volume of air at low speed, the effort is for naught and again the solution is likely to end up on the child's clothing or in the child's mouth. It should be noted that a prepared aqueous solution may sit on a counter for years and the bacteria count unacceptable for placement in any child's mouth. Once a child is finished playing with a wand, there is no simple way of storing it other than returning the wand to a solution bottle.

No one heretofore has addressed the need for an apparatus or device that provides the functionality of a wand yet extends the device away from the child, has a means for adjusting the air volume, velocity, and has a storage cap for transporting. It is, therefore, to the effective resolution of the aforementioned problems and shortcomings of the prior art that the present invention is directed.

SUMMARY OF INVENTION

Generally, the instant invention relates to a blow pipe for the production of bubbles which incorporates the advantages of a wand without the associated drawbacks. The present invention provides an adjustable blow pipe for bubble formation that is capable of adjusting air volume and velocity as directed through the pipe. The bubble pipe includes a first tubular member slidably insertable into a second tubular member, the juxtapose members each having a plurality of orifices formed therein and operatively associated with the other member orifice. At one end of a member is provided a means for attaching an aqueous solution. When a child blows though one end of the device, a bubble is formed from the aqueous solution. The members further allow an adjustment of air thus any age child, despite the child's inability to vary air velocity, can now successfully make a bubble.

The greatest single impediment to successful bubble blowing by children is blowing too hard. The instant device is able to reduce the volume by use of the adjustable vents. The adjustable vents permit successful control of large and small diameter pipes by regulating the volume of air therethrough. Small diameter pipes are known for their ability to channel a high velocity of air defeating all possibility of bubble formation. Thus, use of the instant invention on small diameter pipes and/or openings allow formation of bubbles not hereto possible.

Accordingly, it is the primary objec' of the present invention to provide a bubble pipe with the functionality of a bubble wand and an ability to adjust the velocity and volume of air used in the formation of a bubble.

Another object of the present invention is to provide a bubble pipe that is storable by insertion into a storage cap.

Still another object of the present invention is to provide orifices that are diagonal to the length of the pipe for additional adjustability.

Still another object of the present invention is to provide a bubble pipe that is expandable thereby extending the solution dipped end of the device away from the operators body yet allow the device to collapse into a compact size for storage.

Other objects and advantages of this invention will become apparent from the following description taken in conjunction with the accompanying drawings wherein set forth, by way of illustration and example, certain embodiments of this invention. The drawings constitute a part of this specification and include exemplary embodiments of the present invention and illustrate various objects and features thereof.

BRIEF DESCRIPTION OF THE DRAWINGS

The invention may be better understood by reference to the drawings in which.

DETAILED DESCRIPTION OF THE INVENTION

As required, detailed embodiments of the present invention are disclosed herein, however, it is to be understood that the disclosed embodiments are merely exemplary of the invention which may be embodied in various forms. Therefore, specific functional and structural details disclosed herein are not to be interpreted as limiting, but merely as a basis for the claims and as a representative basis for teaching one skilled in the art to variously employ the present invention in virtually any appropriately detailed structure.

Figure 1:
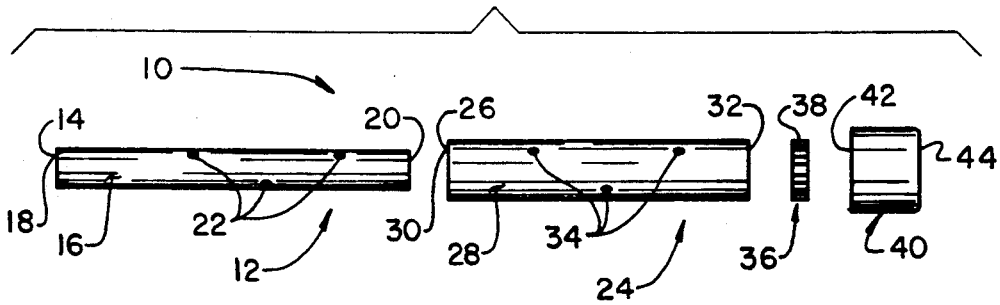
FIG. 1 is an exploded side view of the instant invention.

Referring to FIG. 1, an exploded side view of the instant invention 10 is shown. A first elongated hollow tubular member 12 is defined by a sidewall having an inner surface 14 and outer surface 16 and first open end 18 and a second open end 20. The first member 12 having a plurality of orifices 22 disposed through the sidewall fluidly communicating the inner surface 14 with the outer surface 16. The length of the first member 12 is not limited by this disclosure as a one inch long device having an inner diameter of two inches is as effective as a device two feet long having an inner diameter of one sixteenth of an inch. The actual size of the device is dependent upon the size of the bubble sought to be created and thus not deemed limited by this disclosure. For purposes of this disclosure the device may be viewed as between four and ten inches long having an inner diameter between one fourth and three quarters of an inch.

A second elongated hollow tubular member 24 is shown having a side wall defined by an inner surface 26 and an outer surface 28, a first open end 30 and a second open end 32, said second member side wall having a plurality of orifices 34 disposed through the sidewall and fluidly communicating the inner surface 26 with the outer surface 28. Similar to the first member 12, the second member 28 is not limited in length or diameter for the purpose of this specification as such length and diameter is a function of the size of bubble to be formed. However, for purposes of this specification the member 24 may be viewed as between four and ten inches long having an inner diameter formed by surface 26 slightly larger than the outer diameter of first member 12.

A wand ring 36 is depicted with a plurality of ridges 38 formed therein for supporting a film bubble solution thereacross. The wand ring 36 is coupled to the second end 32 of second member 24. Alternatively, the ridges 38 can be machined directed onto the second end 32 eliminating the need for a separate ring 36.

End cap 40 is depicted having a diameter slightly larger than the diameter of the second member 24 as defined by sidewall 28 and wand ring 36. The end cap has an open end 42 can be made of a conformal material to releasably slip over ring 36 and a portion of second member 24. The end cap 40 is used for storing of the device in an upright position such as in a child's shirt pocket, wherein drippings from the device is collected in the end cap 40 to prevent spotting of the clothing. Members 12, 24, 38, and 40 can be constructed of plastic or the like material and colored for further enhancement.

Figure 2:
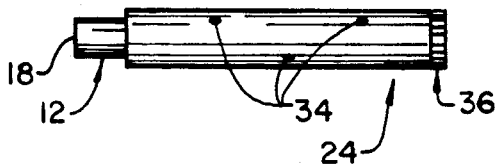
FIG. 2 is a side elevation view of the instant invention with each component connected.
Figure 3:
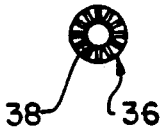
FIG. 3 is an end view illustrating the means for supporting a film solution.
Figure 4:
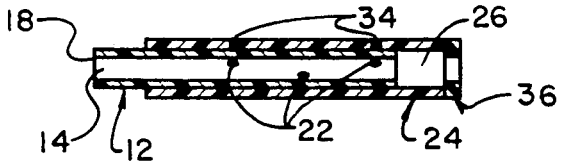
FIG. 4 is an enlarged cross sectional side view.

Now referring to FIGS. 2–4, the first member 12 is slidably insertable into the second member 24 wherein the first member 12 sidewall orifices 22 are operative associated with the second member 24 sidewall orifices 34. Direct alignment of the first member 12 orifices 22 with the second member 24 orifices 34 allow for the expulsion of air directed through opening 18 thus lessening the velocity and volume directed though the pipe and against any film solution placed across wand ring 36. Orifices 22 and 34 can also be made of elongated slots extending through the sidewall of the respective member and placed along at least a portion of each respective member. FIG. 3 illustrates the end view of the device wherein the ridges 38 of wand ring 36 present an enlarged surface area for adherence of an aqueous bubble solution.

Figure 5:
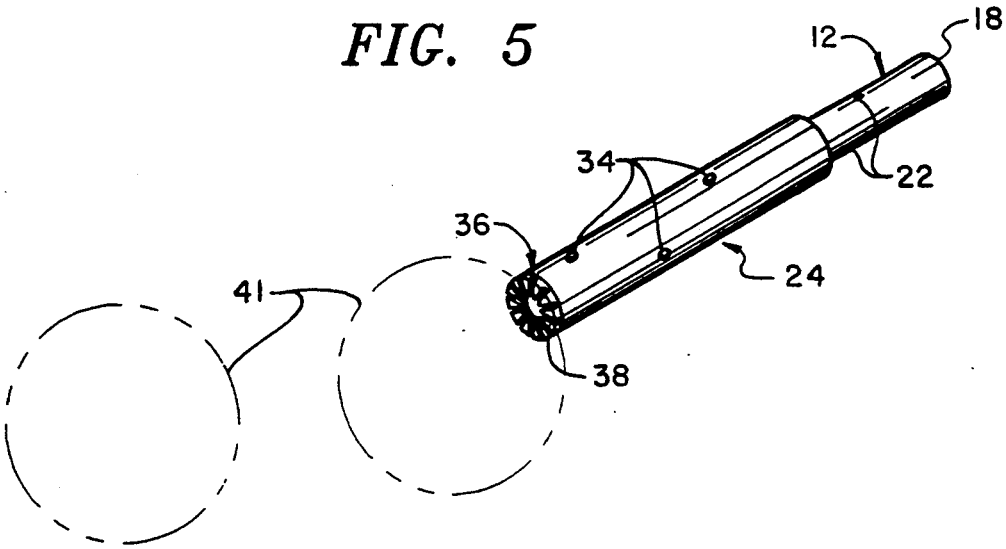
FIG. 5 is a perspective view of the apparatus.

FIG. 5 illustrates the operation of the device wherein the wand ring 36 is dipped into a solution and the ridges 38 provide sufficient surface area for attachment adherence of an aqueous solution thereto. A person grasping the device's second member 24 with one hand and first member 12 with the other hand permits rotation of either member with respect to the other until orifices 22 and 34 of the members 12 and 24 respectively are in alignment. Variation of the alignment then adjusts the volume and velocity of air that travels through the pipe members to wand ring 36. From this expulsion of air through the wand ring a bubble 40 is formed. The inner member 12 may also be slid outward from the wand end 36 extending the overall length of the device to further distance the wand end 36 from the operator thus lessening or eliminating the ability of solution from dropping on the operator's clothing.

When the operator is completed with operation of the device, inner member 12 can be inserted into outer member 24 making the device compact for storage. Further, end cap 40 can now be placed over the end of the device so that if the child or operator places the device into pants or shirt pocket, the end cap will collect the dripping and prevent staining of clothing. It should be noted that first member 12 can be larger that second member 24 making second member slidably insertable into the first member 12 without defeating the object of this invention.

It is to be understood that while we have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What I claim as new and desire to secure by Letters Patent of the United States is:

1. A bubble pipe comprising: a first elongated hollow tubular member defined by a sidewall having an inner and outer surface and first and second open ends, said first member sidewall having a plurality of orifices disposed therethrough; a second elongated hollow tubular member defined by a sidewall having an inner and outer surface and first and second open ends, said second member sidewall having a plurality of orifices disposed therethrough; and, a plurality of ridges disposed along the open end of one of said members for support of an aqueous bubble solution placed across said ridges, one of said members slidably insertable and rotatable into the other member wherein said member sidewall orifices are juxtaposition for expulsion of air delivered through one said member lessening the velocity and volume directed through said first and second member and against said solution; whereby the placement of an aqueous bubble solution across said ridges of said open end followed by a direction of air through said members whose air velocity is controlled by slidably rotation thereof, forms a bubble by placement of the air within the solution.

2. The bubble pipe according to claim 1, wherein said ridges of said second end are formed by attachment of a conventional wand ring to one end of said first or second member.

3. The bubble pipe according to claim 1, wherein said plurality of orifices are substantially circular openings extending through the sidewall of the respective member.

4. The bubble pipe according to claim 1, wherein said plurality of orifices are substantially elongated slots extending through the sidewall of the respective member and placed along at least a portion of the respective member.

5. The bubble pipe according to claim 4, wherein said elongated slots are diagonal to the length of the pipe.

6. The bubble pipe according to claim 1, wherein said bubble pipe further comprises a conformal end cap releasably attached to said second end of said second member.

7. A bubble pipe comprising: a first elongated hollow tubular member defined by a sidewall having an inner and outer surface and first and second open ends, said first member sidewall having a plurality of orifices disposed therethrough; a second elongated hollow tubular member defined by a sidewall having an inner and outer surface and first and second open ends, said second member sidewall having a plurality of orifices disposed therethrough; and, a conformal end cap having a plurality of raised edges providing an increased surface area for attaching of a film solution thereto, said first member slidably insertable and rotatable into said second member wherein said first member sidewall orifices are operative associated with said second member sidewall orifices for expulsion of air delivered through said first member lessening the velocity and volume directed though said first and second member and against said solution; whereby the placement of an aqueous bubble solution across said conformal end cap of said second open end followed by a direction of air through said first and second members whose air velocity is controlled by slidably rotation thereof, forms a bubble by placement of the air within the solution.

8. The bubble pipe according to claim 1, wherein said second member is made insertable into said first member.

9. The bubble pipe according to claim 1, wherein said first member is made insertable into said second member.

10. A bubble pipe comprising: a first elongated hollow plastic tubular member defined by a sidewall having an inner and outer surface and first and second open ends, said first member sidewall having a plurality of orifices disposed therethrough; a second elongated hollow plastic tubular member defined by a sidewall having an inner and outer surface and first and second open ends, said second member sidewall having a plurality of orifices disposed therethrough; and, a conventional wand ring coupled to said open end of said second member for support of an aqueous bubble solution placed across said wand ring, said first member slidably insertable and rotatable into said second member wherein said first member sidewall orifices are operative associated with said second member sidewall orifices for expulsion of air delivered through said first member lessening the velocity and volume directed through said first and second member and against said solution; whereby the placement of an aqueous bubble solution across said wand ring of said second open end followed by a direction of air through said first and second members whose air velocity is controlled by slidably rotation thereof, forms a bubble by placement of the air within the solution.

* * * * *